US011299948B2

(12) United States Patent
Krüger

(10) Patent No.: US 11,299,948 B2
(45) Date of Patent: Apr. 12, 2022

(54) DOWNHOLE METHOD FOR REMOVAL OF TUBULAR METAL STRUCTURE

(71) Applicant: Welltec A/S, Allerød (DK)

(72) Inventor: Christian Krüger, Allerød (DK)

(73) Assignee: Welltec A/S, Allerød (DK)

( * ) Notice: Subject to any disclaimer, the term of this patent is extended or adjusted under 35 U.S.C. 154(b) by 24 days.

(21) Appl. No.: 16/735,940

(22) Filed: Jan. 7, 2020

(65) Prior Publication Data

US 2020/0217159 A1 Jul. 9, 2020

(30) Foreign Application Priority Data

Jan. 8, 2019 (EP) ..... 19150862
Oct. 3, 2019 (EP) ..... 19201290
Oct. 4, 2019 (EP) ..... 19201492

(51) Int. Cl.
*E21B 23/01* (2006.01)
*E21B 29/00* (2006.01)
*E21B 33/12* (2006.01)
*E21B 33/138* (2006.01)

(52) U.S. Cl.
CPC ..... *E21B 29/005* (2013.01); *E21B 23/01* (2013.01); *E21B 33/12* (2013.01); *E21B 33/138* (2013.01)

(58) Field of Classification Search
CPC ..... E21B 29/002; E21B 29/005; E21B 23/01; E21B 33/12
See application file for complete search history.

(56) References Cited

U.S. PATENT DOCUMENTS

| | | | |
|---|---|---|---|
| 2,481,637 | A | 9/1949 | Yancey |
| 5,101,895 | A | 4/1992 | Gilbert |
| 2011/0000668 | A1 | 1/2011 | Tunget |
| 2018/0106124 | A1 | 4/2018 | Hazel |

FOREIGN PATENT DOCUMENTS

NO 20180152 4/2018

OTHER PUBLICATIONS

Extended Search Report for EP19150862.1 dated Nov. 22, 2019, 5 pages.
Christian Krüger., U.S. Appl. No. 16/735,934, filed Jan. 7, 2020.
Written Opinion of the International Searching Authority with International Search Report dated Apr. 14, 2020 in International Application No. PCT/EP2020/050155, 11 pages.

*Primary Examiner* — Catherine Loikith
(74) *Attorney, Agent, or Firm* — Nixon & Vanderhye P.C.

(57) ABSTRACT

A method for removal of at least part of a first well tubular metal structure in a borehole of an existing well having a top, the first well tubular metal structure having a longitudinal extension and a first end closest to the top. The method includes inserting a downhole wireline tool having an anchor section and a machining device in the first well tubular metal structure, positioning the downhole wireline tool opposite the first section of the first well tubular metal structure so that the machining device is positioned 8-12 metres from the first end of the first well tubular metal structure and the anchor section is arranged above the machining device, and anchoring the downhole wireline tool opposite the first section by activating the anchor section to abut an inner surface of the first well tubular metal structure.

15 Claims, 16 Drawing Sheets

DOWNHOLE METHOD FOR REMOVAL OF TUBULAR METAL STRUCTURE

Figure 1:
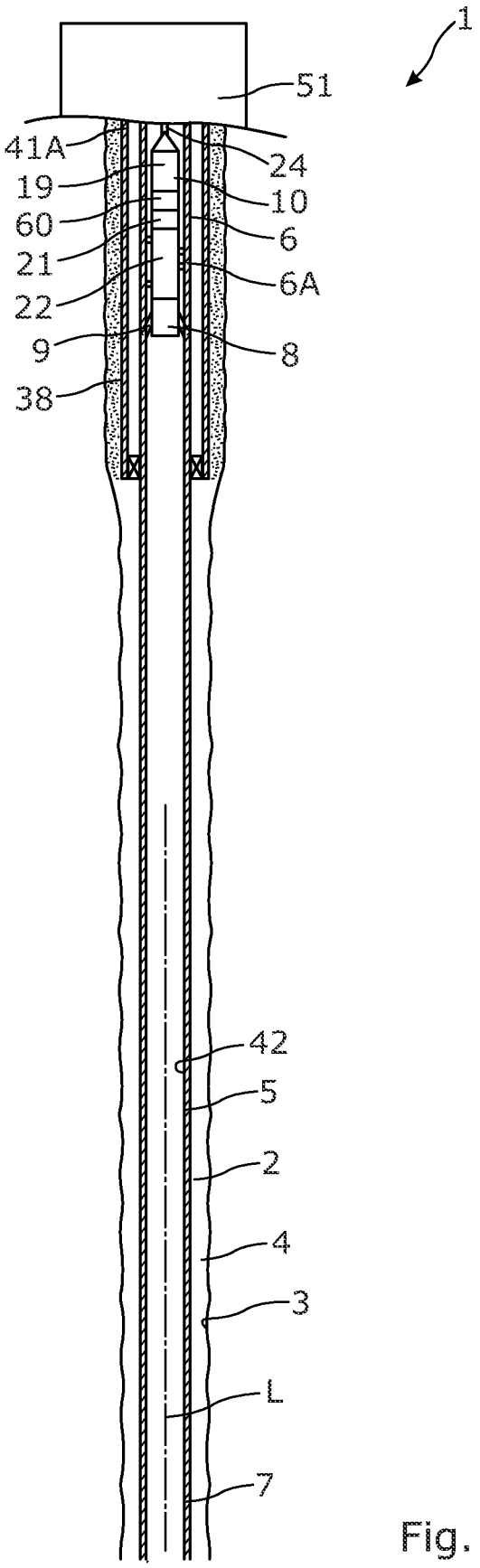

This application claims priority to EP Patent Application No. 19150862.1 filed Jan. 8, 2019, EP Patent Application No. 19201290.4 filed Oct. 3, 2019 and EP Patent Application No. 19201492.6 filed Oct. 4, 2019, the entire contents of each of which are hereby incorporated by reference.

The present invention relates to a downhole method for removal of at least part of a first well tubular metal structure in a borehole of an existing well having a top, the first well tubular metal structure having a longitudinal extension and a first end closest to the top.

When existing wells fails to perform as intended, and the production of hydro-carbon containing fluid dwindles from a specific well or a well produces a high content of water, it is necessary for the operator to decide whether to optimise the well or if the well should be abandoned.

In order to optimise more simple wells, the zones producing too much water can be isolated e.g. by inserting a patch over a perforated zone or other types of production openings; however, the water from the isolated zone may flow parallelly on the outside of the well tubular metal structure into other producing zones if the cement is not sufficient to seal the annulus and with the known solution it may be difficult to optimise such wells and these are more likely to be plugged and abandoned even though some zones may still be producing an acceptable amount of hydrocarbon containing fluid in other areas of the reservoir.

It is an object of the present invention to wholly or partly overcome the above disadvantages and drawbacks of the prior art. More specifically, it is an object to provide an improved downhole method capable of optimising also more simple wells in a satisfying manner.

The above objects, together with numerous other objects, advantages and features, which will become evident from the below description, are accomplished by a solution in accordance with the present invention by a downhole method for removal of at least part of a first well tubular metal structure in a borehole of an existing well having a top, the first well tubular metal structure having a longitudinal extension and a first end closest to the top, comprising

- inserting a downhole wireline tool having an anchor section and a machining device in the first well tubular metal structure,
- positioning the downhole wireline tool opposite the first section of the first well tubular metal structure so that the machining device is positioned 8-12 metres from the first end of the first well tubular metal structure and the anchor section is arranged above the machining device,
- anchoring the downhole wireline tool opposite the first section by activating the anchor section to abut an inner surface of the first well tubular metal structure,
- separating the first section having a length of 8-12 metres from a second section of the first well tubular metal structure by machining into and along a circumference of the first well tubular metal structure,
- retrieving the first section from the well by pulling in the wireline creating a new first end of the first well tubular metal structure in the well,
- inserting the downhole wireline tool into the first well tubular metal structure again,
- positioning the downhole wireline tool opposite the new first section of the first well tubular metal structure so that the machining device is positioned 8-12 metres from the new first end of the first well tubular metal structure and the anchor section is arranged above the machining device,
- anchoring the downhole wireline tool opposite the new first section by activating the anchor section to abut the inner surface of the first well tubular metal structure,
- separating the new first section having a length of 8-12 metres from the rest of the first well tubular metal structure by machining into and along the circumference of the first well tubular metal structure, and
- retrieving the new first section from the well by pulling in the wireline.

The above objects, together with numerous other objects, advantages and features, which will become evident from the below description, are accomplished by a solution in accordance with the present invention by a downhole method for removal of at least part of a first well tubular metal structure in a borehole of an existing well having a top, the first well tubular metal structure having a longitudinal extension and a first end closest to the top, comprising

- inserting a downhole wireline tool having an anchor section and a machining device in the first well tubular metal structure,
- positioning the downhole wireline tool opposite the first section of the first well tubular metal structure so that the machining device is positioned 8-12 metres from the first end of the first well tubular metal structure and the anchor section is arranged above the machining device,
- anchoring the downhole wireline tool opposite the first section by activating the anchor section to abut an inner surface of the first well tubular metal structure,
- separating the first section having a length of 8-12 metres from a second section of the first well tubular metal structure by machining into and along a circumference of the first well tubular metal structure,
- retrieving the first section from the well by pulling in the wireline creating a second first end of the first well tubular metal structure in the well,
- inserting the downhole wireline tool into the first well tubular metal structure again,
- positioning the downhole wireline tool opposite the second first section of the first well tubular metal structure so that the machining device is positioned 8-12 metres from the second first end of the first well tubular metal structure and the anchor section is arranged above the machining device,
- anchoring the downhole wireline tool opposite the second first section by activating the anchor section to abut the inner surface of the first well tubular metal structure,
- separating the second first section having a length of 8-12 metres from the rest of the first well tubular metal structure by machining into and along the circumference of the first well tubular metal structure, and
- retrieving the second first section from the well by pulling in the wireline.

Thus, the first section firstly separated from the second section being the remaining part of the first well tubular metal structure is the first first section, and when separated and retrieved from the well, then a new first section appears which is the second first section of the first well tubular metal structure. When the second first section is separated and retrieved from the well a new first section appears which is the third first section to be separated and retrieved from the well and so forth.

Moreover, the downhole method may be a downhole workover method.

In addition, the first well tubular metal structure may be separated into several first sections with a length of 8-12 metres.

Further, the downhole method may further comprise machining into a liner hanger in order to release the part of the first well tubular metal structure hung off in the liner hanger.

Also, the first well tubular metal structure may be separated into several first sections with a length of 8-12 metres until a predetermined position along the first well tubular metal structure.

Additionally, the downhole method may further comprise setting a plug above or below the predetermined position.

Moreover, the downhole method may further comprise inserting a logging tool to detect the conditions of the cement in the borehole to determine where the cement is of a sufficiently good condition to obtain a sufficient plug and abandonment operation.

Furthermore, the downhole method may further comprise inserting a cement tool into the well and ejecting cement into the borehole above the predetermined position.

The downhole wireline tool may be a wireline downhole wireline tool.

Also, the downhole wireline tool may have a driving unit.

Furthermore, the downhole wireline tool may comprise a machining device, the machining device having at least one arm which is pivotably connected with the downhole wireline tool and has a cutting edge in a first end, the arm being movable between a retracted position and a projected position in relation to the downhole wireline tool.

Moreover, the machining part of the well tubular metal structure may be performed by milling a part of the well tubular metal structure in the longitudinal extension.

The downhole method may further comprise inserting a second well tubular metal structure in the borehole above the predetermined position.

In addition, the second well tubular metal structure may comprise at least one annular barrier.

Further, an annular barrier may be arranged above the predetermined position and the second well tubular metal structure above the annular barrier.

Additionally, an unexpanded annular barrier may be inserted between the first well tubular metal structure and the second well tubular metal structure.

Moreover, the annular barrier may be expanded for providing zonal isolation at the predetermined position.

Inserting the unexpanded annular barrier may be performed by a downhole wireline tool.

The unexpanded annular barrier may be inserted through the first section.

Furthermore, the annular barrier may comprise a tubular metal part, an expandable metal sleeve surrounding the tubular metal part, an annular space between the tubular metal structure and the expandable metal sleeve, the tubular metal part having an expansion opening.

In addition, the tubular metal part may be mounted as part of the well tubular metal structure.

Moreover, the annular barrier may comprise an expandable metal sleeve.

Further, the annular barrier may comprise a tubular part and a surrounding swellable material.

In addition, expanding the annular barrier may be performed by a swelling process of the swellable material of the annular barrier.

Also, expanding the annular barrier may be performed by pressurising at least a part of the second well tubular metal structure.

In addition, the pressurising may be performed by a downhole tool string isolating a part of the second well tubular metal structure.

Furthermore, the pressurising may be performed by pressurising the second well tubular metal structure from the surface.

Moreover, expansion of the annular barrier may be performed by expanding the tubular metal part and/or the expandable metal sleeve.

Further, expansion of the annular barrier may be performed by means of a mandrel and/or an expandable bladder.

In addition, expansion of the annular barrier may be performed by pressurising the tubular metal part opposite the expansion opening in the tubular metal part and letting fluid into the annular space for expanding the expandable metal sleeve.

Moreover, the expandable metal sleeve may be radially expanded between the first well tubular metal structure and the second well tubular metal structure to abut the wall of the borehole.

Additionally, the annular barrier may have a first barrier end and a second barrier end, the first barrier end being configured to overlap the first well tubular metal structure and the second barrier end being configured to overlap the second well tubular metal structure.

The downhole method may further comprise providing a second zonal isolation at a second predetermined position in the annulus between the wall of the borehole and the second well tubular metal structure.

The invention also relates to a downhole system for performing the downhole method as described above.

Figure 2:
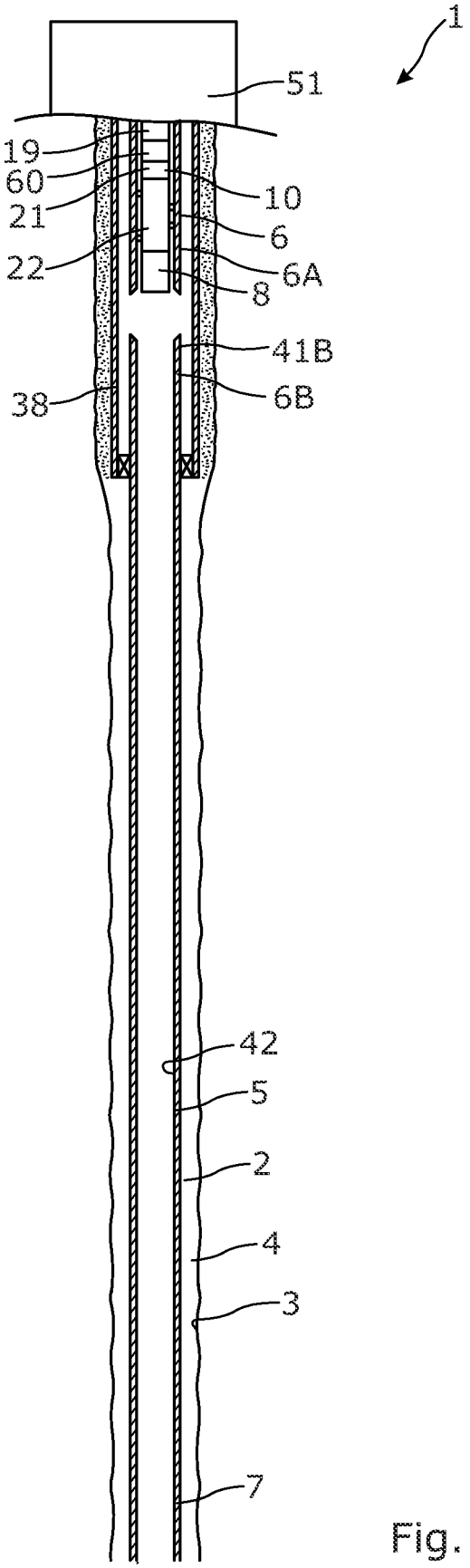
Figure 3A:
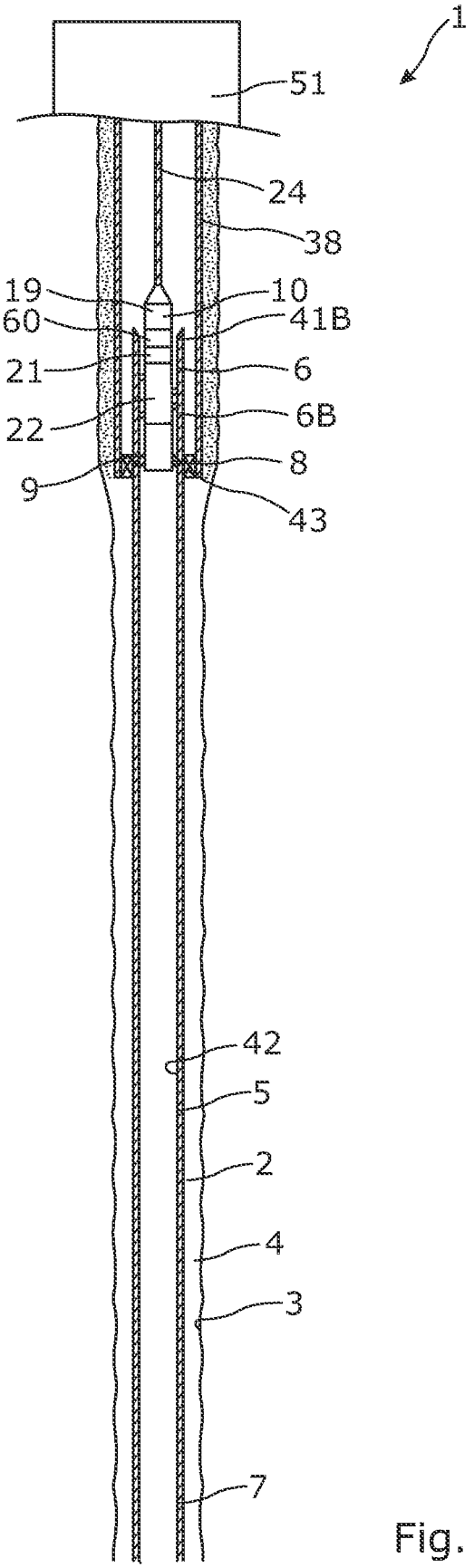
Figure 3B:
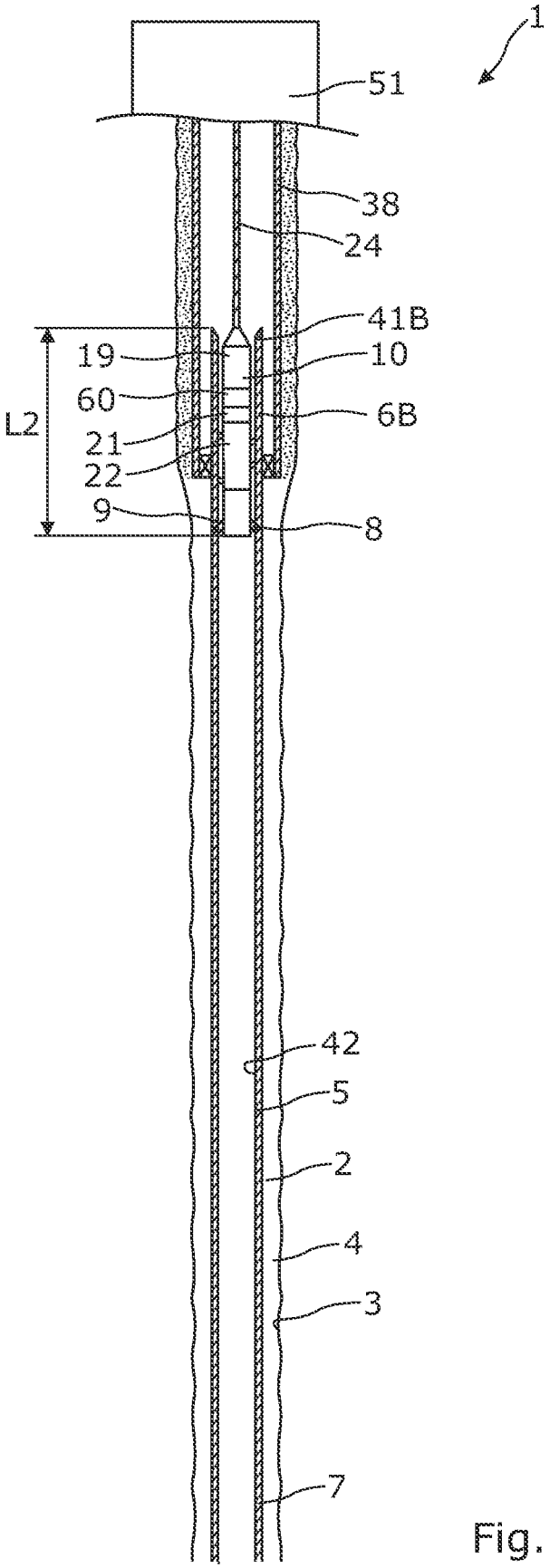
Figure 4:
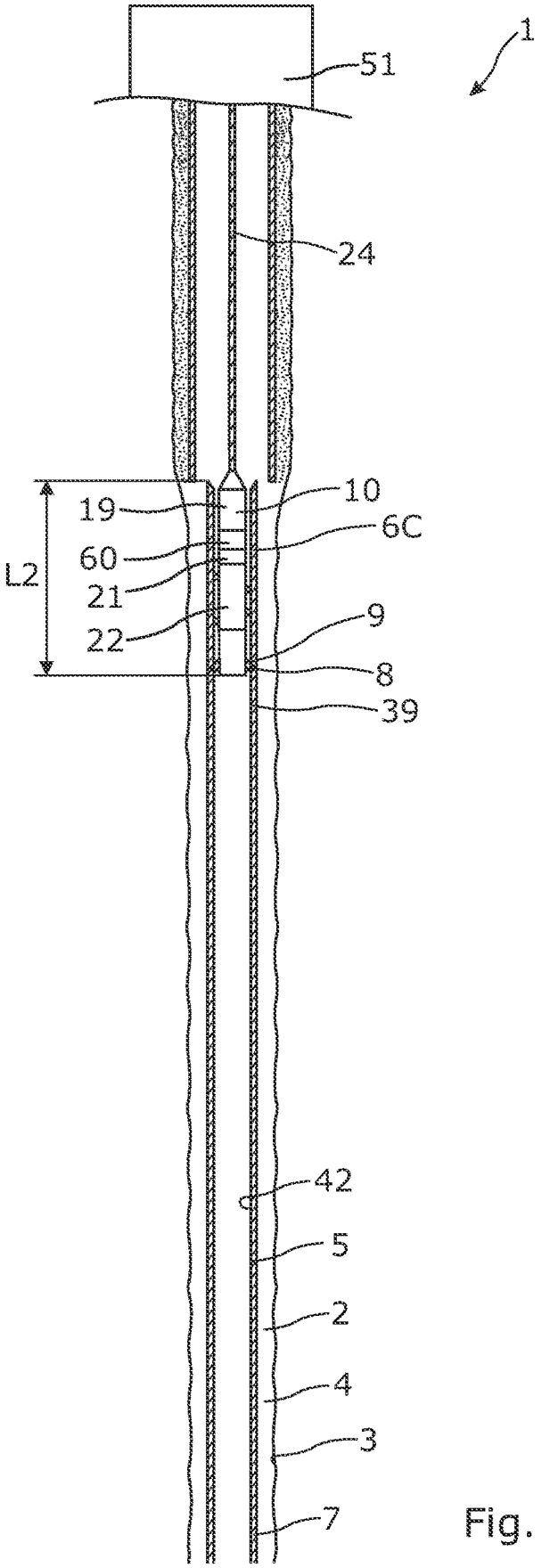
Figure 5:
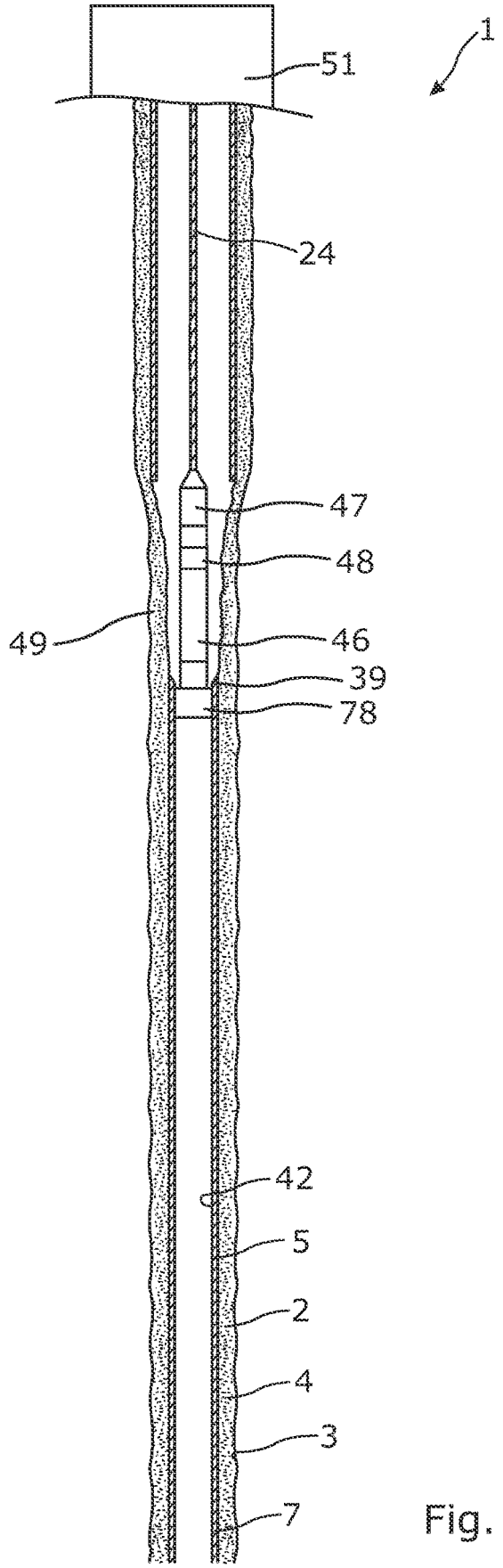
Figure 6:
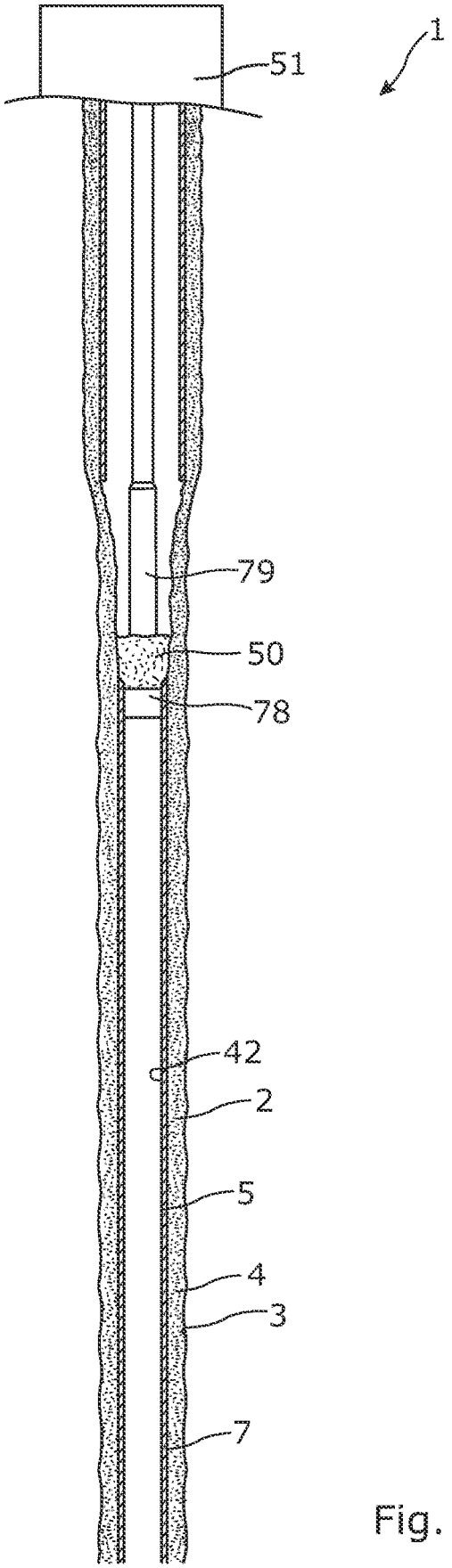
Figure 7:
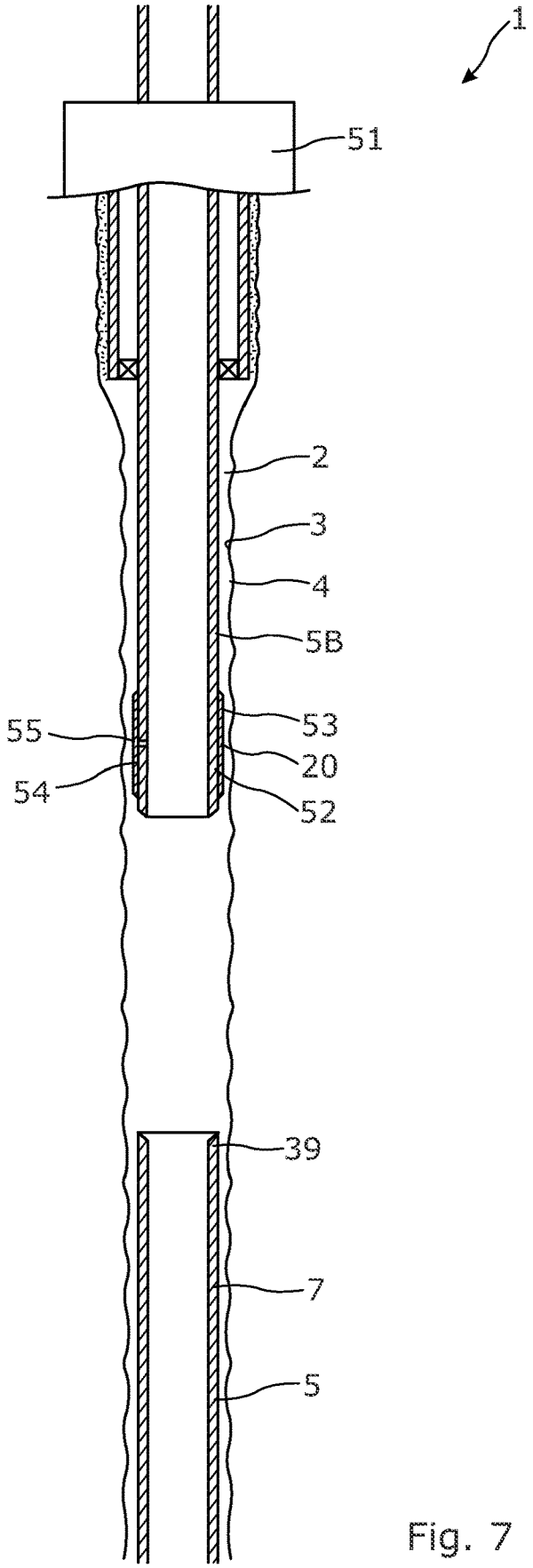
Figure 8:
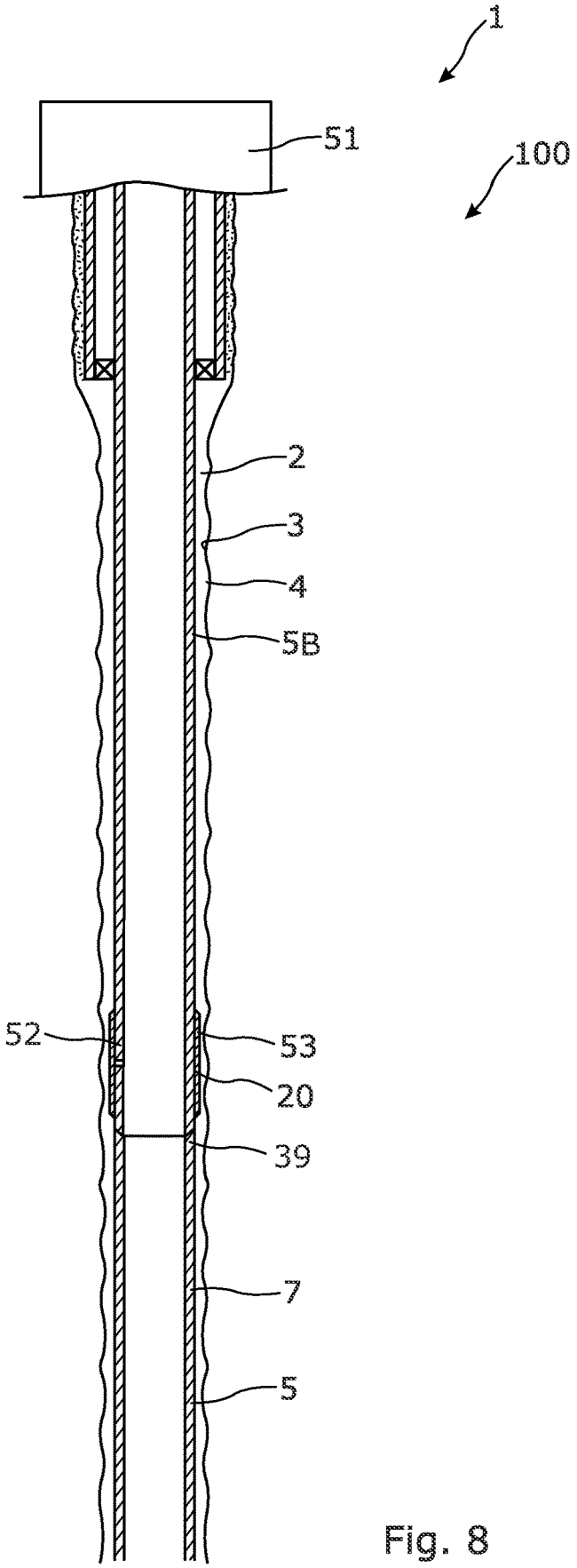
Figure 9:
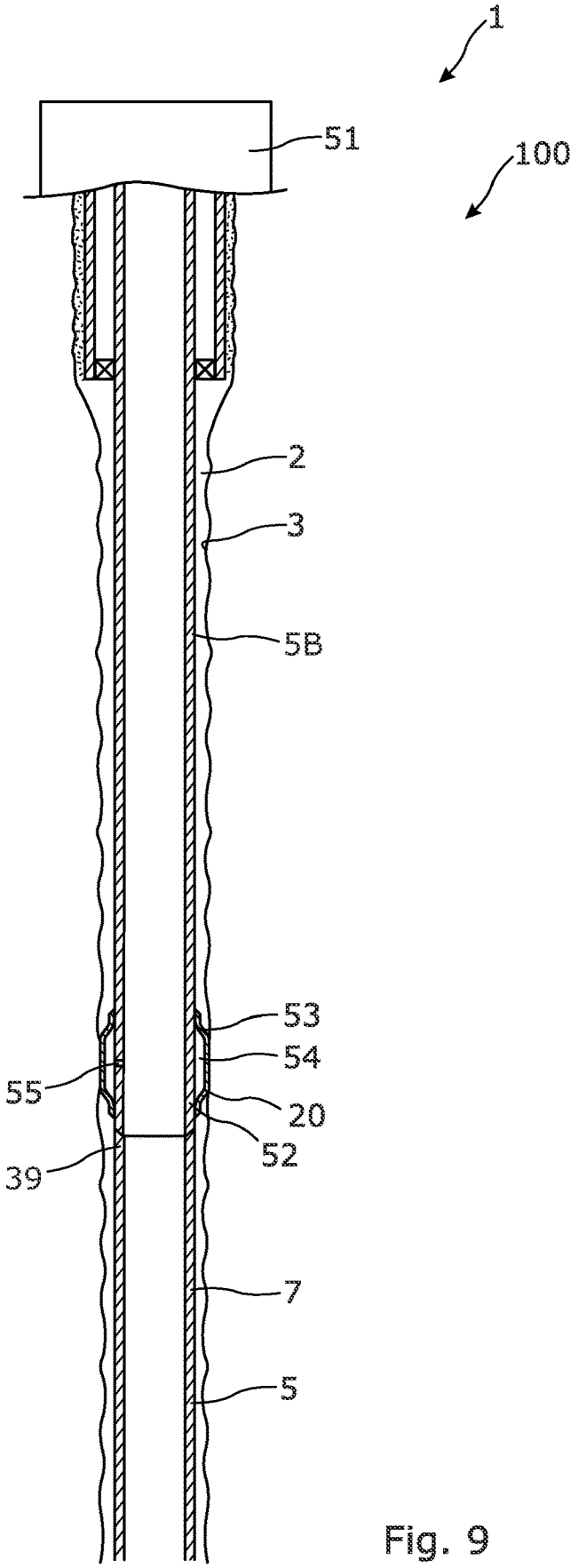
Figure 10:
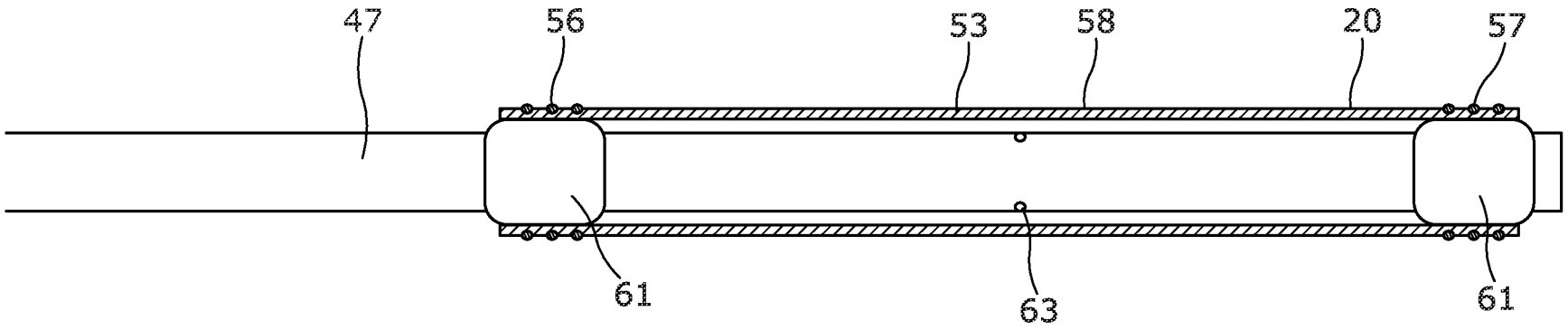
Figure 11:
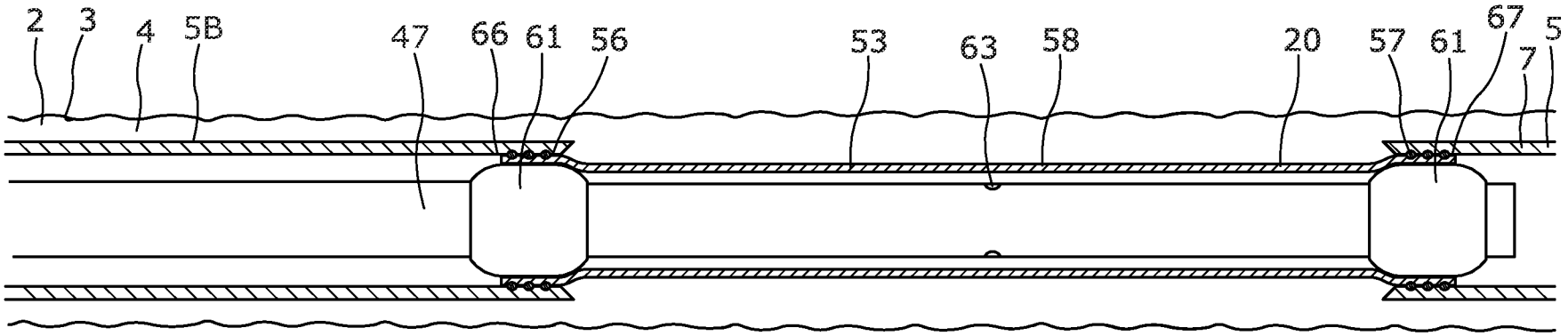
Figure 12:
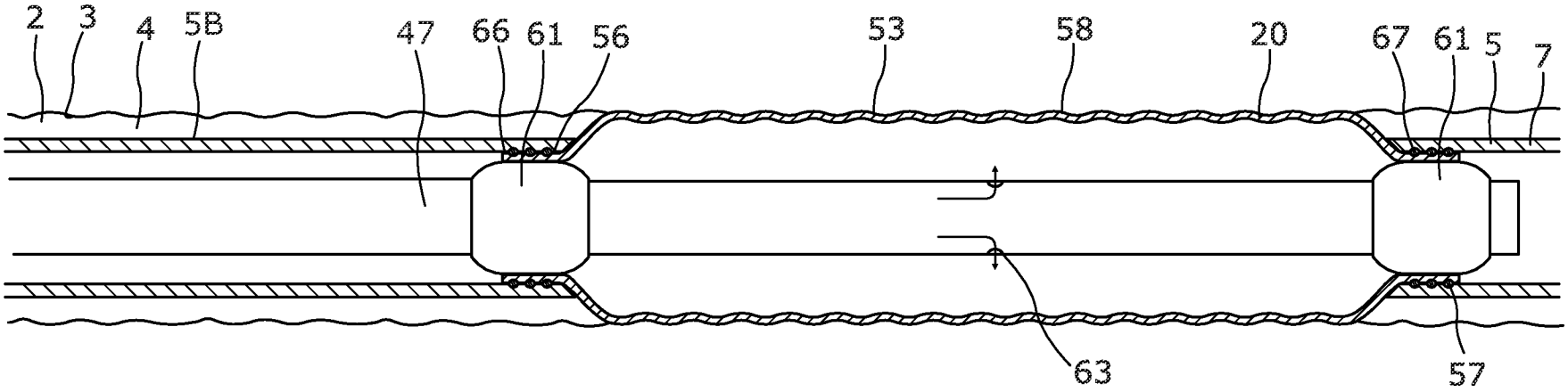
Figure 13:
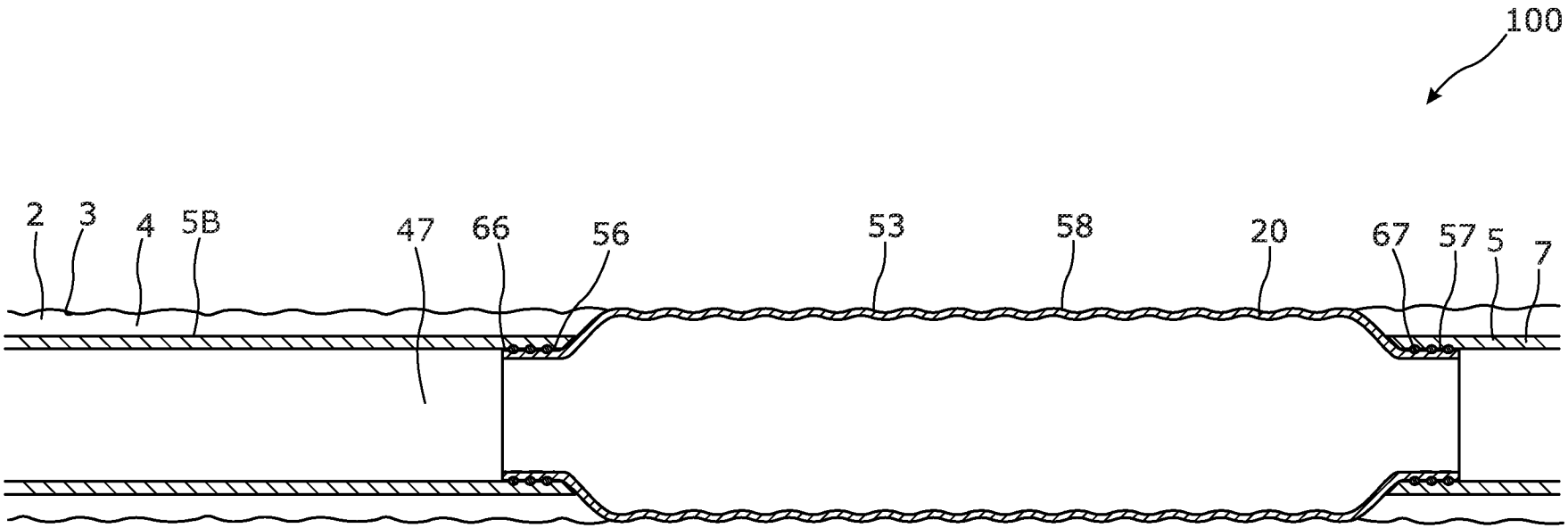
Figure 14:
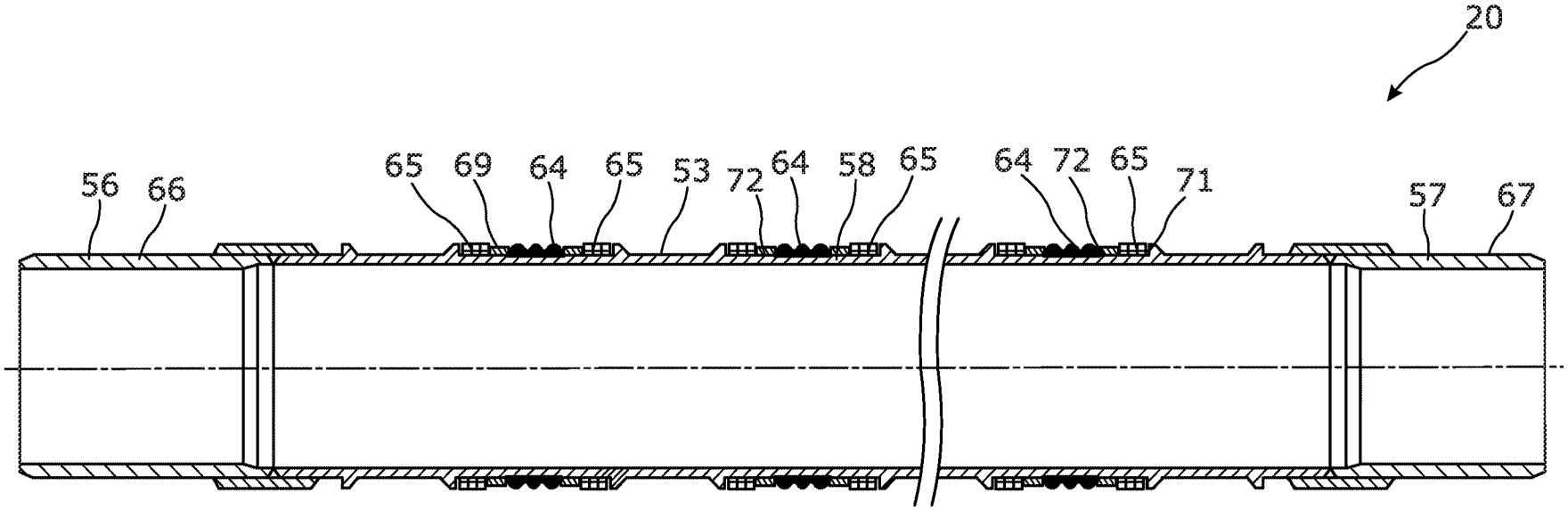
Figure 15:
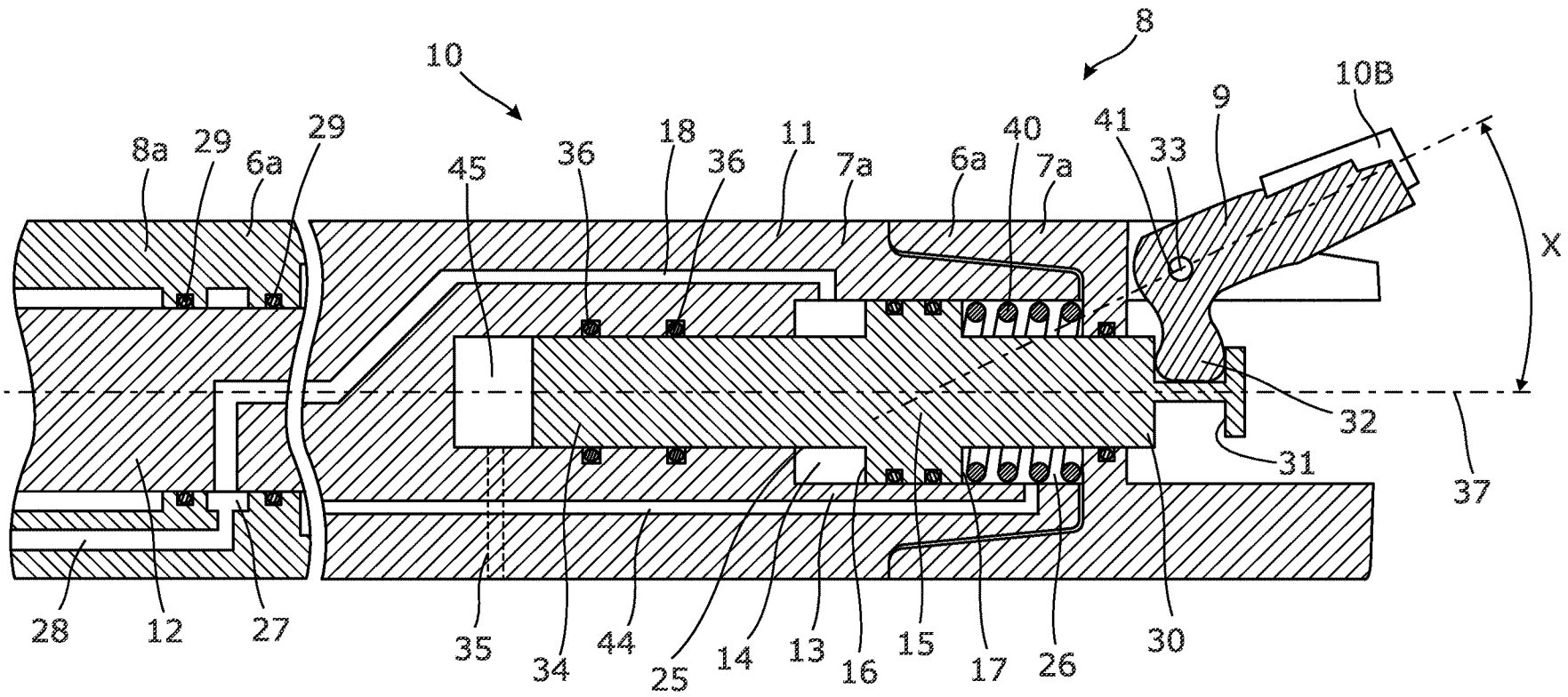

The invention and its many advantages will be described in more detail below with reference to the accompanying schematic drawings, which for the purpose of illustration show some non-limiting embodiments and in which:

FIG. 1 is a partially cross-sectional view of a well tubular metal structure in which a downhole wireline tool is inserted for separating a first section of the well tubular metal structure from a second section of the well tubular metal structure, FIG. 2 is a partially cross-sectional view of the well tubular metal structure of FIG. 1 where the separated first section is being pulled out of the well, FIG. 3A is a partially cross-sectional view of the well tubular metal structure of FIG. 2 in which a new first section of the first well tubular metal structure is separated from the second section of the first well tubular metal structure while machining into the liner hanger, FIG. 3B is a partially cross-sectional view of the well tubular metal structure of FIG. 2 in which a new first section of the first well tubular metal structure is separated from the second section of the first well tubular metal structure, FIG. 4 is a partially cross-sectional view of the well tubular metal structure of FIG. 3A in which yet a new first section of the first well tubular metal structure is separated from the second section of the first well tubular metal structure, FIG. 5 is a partially cross-sectional view of the well tubular metal structure of FIG. 4 where the downhole wireline tool has been removed and a plug setting tool sets a plug in the first well tubular metal structure, FIG. 6 is a partially cross-sectional view of the well tubular metal structure of FIG. 4 where cement is poured into the well to make a cement plug above the plug and the first well tubular metal structure, FIG. 7 is a partially cross-sectional view of the well tubular metal structure of FIG. 4 in which several first sections have been pulled out one by one of the well and an unexpanded annular barrier mounted at the end of the second well tubular metal structure is being run into the well, FIG. 8 is a partially cross-sectional view of the well tubular metal structure of FIG. 7 in which the annular barrier has been arranged at the predetermined position, FIG. 9 is a partially cross-sectional view of the well tubular metal structure of FIG. 8 in which the annular barrier has been expanded, FIG. 10 shows a partially view of a downhole wireline tool surrounded by an expandable metal sleeve (shown in cross-section) of an annular barrier, FIG. 11 shows a partially cross-sectional view of a well tubular metal structure in which the tool of FIG. 10 has been arranged opposite the predetermined position and end parts of the expandable metal sleeve has been expanded, FIG. 12 is a partially cross-sectional view of the well tubular metal structure of FIG. 11 in which also a part of the expandable metal sleeve intermediate the end parts has been expanded by pressurised fluid from the tool, FIG. 13 is a cross-sectional view of the well tubular metal structure of FIG. 12 where the downhole wireline tool has been removed, FIG. 14 shows a cross-sectional view of an annular barrier, and FIG. 15 shows a cross-sectional view of part of the downhole wireline tool having projectable arms with a cutting edge for machining into the wall of the well tubular metal structure.

All the figures are highly schematic and not necessarily to scale, and they show only those parts which are necessary in order to elucidate the invention, other parts being omitted or merely suggested.

FIG. 1 shows part of a downhole method for removal of at least part of a first well tubular metal structure 5 in a borehole 4 of an existing well 1 having a top 51. The first well tubular metal structure has a longitudinal extension L and a first end 41A closest to the top. In FIG. 1, a downhole wireline tool 10 is inserted in the first well tubular metal structure, and the downhole wireline tool has an anchor section 22 and a machining device 8. The downhole wireline tool is positioned opposite a first section 6 of the first well tubular metal structure 5 so that the machining device 8 is positioned 8-12 metres from the first end 41A of the first well tubular metal structure, and the anchor section 22 is arranged above the machining device. In FIG. 1, the downhole wireline tool is anchored opposite the first section by activating the anchor section to abut an inner surface 42 of the first well tubular metal structure. The machining device 8 separates the first section 6 from a second section 7 of the first well tubular metal structure by machining into and along a circumference of the first well tubular metal structure. The first section has a length L2 (shown in FIGS. 3B and 4) of 8-12 metres. Then as shown in FIG. 2, the first section 6 is retrieved from the well by pulling in the wireline and thus in the tool holding the first section 6, creating a new first end 41B of the first well tubular metal structure in the well. The activated anchor section 22 provides a radial force so that the first section of 8-12 metres just separated from the rest of the first well tubular metal structure can be pulled out by pulling in the wireline from the top, discarding the separated first section at the top in order for the tool to re-enter the well for removing a new first section 6B as shown in FIG. 3A. In FIG. 3B, the downhole wireline tool has been inserted in the first well tubular metal structure again and positioned opposite the new first section 6B of the first well tubular metal structure so that the machining device 8 is positioned 8-12 metres from the new first end 41B of the first well tubular metal structure, and the anchor section 22 is arranged above the machining device 8 and anchors the downhole wireline tool opposite the new first section 6B by activating the anchor section to abut the inner surface of the first well tubular metal structure, and then the new first section 6B having a length of 8-12 metres is separated from the rest of the first well tubular metal structure by machining into and along the circumference of the first well tubular metal structure, and the new first section 6C (shown in FIG. 4) is retrieved from the well by pulling in the wireline and thus the tool. Thus, the downhole method is a downhole workover method.

By separating the well tubular metal structure into several sections 6, 6A, 6B, 6C etc. of 8-12 metres, these sections can be pulled out of the well one by one by using the same tool as the tool separating the well tubular metal structure into sections. Furthermore, the anchor section 22 fastens the separated section 6, 6A, 6B, 6C etc. so that the section is easily pulled out by pulling in the wireline and thus the tool. Pulling a section of the well tubular metal structure out of the well is feasible since sections of 8-12 metres do not weigh more than a wireline can withstand and hold by means of the anchor section. Thus, a very simple way of removing at least part of a well tubular metal structure, so that this part can be replaced with an annular barrier for isolating the deteriorated production zone or for plugging off that part and drill a lateral into another part of the reservoir. The well tubular metal structure is separated into sections being pulled out of the borehole one by one from the top of the well by means of a wireline tool. By this method, no large rig is needed for pulling out the upper part of the well tubular metal structure.

In FIG. 4, the downhole wireline tool 10 has been inserted into the first well tubular metal structure again to separate yet another first section 6C, and in this way the first well tubular metal structure is separated into several first sections with a length of 8-12 metres. The first well tubular metal structure is separated into several first sections with a length of 8-12 metres until a predetermined position 39 along the first well tubular metal structure, as shown in FIGS. 4 and 5, is reached.

As shown in FIG. 3A, the downhole wireline tool 10 machines into a liner hanger 43 in order to release the part of the first well tubular metal structure hung off in the liner hanger. In some completions, the first well tubular metal structure needs to be released from the outer casing 38 and in other completions this is not needed, as shown in FIG. 3B.

The downhole method may be used for replacing a damaged part of a first well tubular metal structure and for replacing that part with a new well tubular metal structure or in order to plug off the well in order to abandon the well or drill a new borehole above the plugged off part. In order to plug off part of the well, a plug 78 is set below the predetermined position 39 by means of a downhole wireline tool string 47 having a setting tool 46, as shown in FIG. 5.

The downhole wireline tool string 47 may comprise a logging tool 48 being inserted in the well to detect the conditions of the cement 49 in the borehole to determine where the cement is of a sufficiently good condition to obtain a sufficient plug and abandonment operation, as shown in FIG. 5.

After having set the plug, a cement tool 79 is inserted in the well and cement is ejected into borehole above the predetermined position as shown in FIG. 6 to provide a full bore cement plug 50, i.e. a cement plug having contact with the wall of the borehole. The cement tool is continuously pulled out of the well while ejecting cement in order to eject cement further up the borehole than shown in FIG. 6.

As shown in FIG. 7, the downhole method may also comprise inserting a second well tubular metal structure 5B in the borehole above the predetermined position, i.e. replacing part of the well tubular metal structure with a second well tubular metal structure. The second well tubular metal structure 5B comprises at least one annular barrier 20. The unexpanded annular barrier is arranged above the predetermined position 39 and the second well tubular metal structure is arranged above the annular barrier where the annular barrier is mounted as part of the second well tubular metal structure. Thus, the unexpanded annular barrier 20 is arranged between the first well tubular metal structure and the second well tubular metal structure and as part of the second well tubular metal structure, as shown in FIG. 8. The second well tubular metal structure 5B may comprise several annular barriers. The one or more annular barriers are expanded for providing zonal isolation above the predetermined position as shown in FIG. 9. The unexpanded annular barrier 20 may also be arranged between the first well tubular metal structure and the second well tubular metal structure, filling out a space therebetween, as shown in FIGS. 11 and 12.

FIG. 1 shows a partially cross-sectional view of the well tubular metal structure in which a downhole wireline tool 10 is inserted for separating the first section 6 of the well tubular metal structure 5 from the second section 7. The downhole wireline tool 10 is inserted in the well tubular metal structure and positioned opposite the predetermined position, and the separation of the first section 6 from the second section 7 of the well tubular metal structure by machining into and along a circumference of the well tubular metal structure is initiated.

Subsequently, the downhole wireline tool 10 is removed from the well. As can be seen, the downhole wireline tool is a wireline downhole tool. The downhole wireline tool may have a driving unit (not shown) for the tool to be self-propelling in e.g. a more horizontal part of the well.

In FIG. 1, the downhole wireline tool 10 comprises an electronic section 19 for controlling the electricity supply before being directed to a rotation unit, such as an electrical motor 60, driving a hydraulic pump 21. The downhole wireline tool further comprises an anchor section 22. The downhole wireline tool 10 is submerged into the well tubular metal structure, and the anchor section 22 of the downhole wireline tool is hydraulically activated to anchor a second part of the tool housing of the tool in relation to the well tubular metal structure 5. The motor is powered through a wireline 24 and the electronic section 19 and drives the pump and rotates a rotatable shaft for rotating the cutting arm 9 for separating the upper and first section 6 from the lower second section 7 of the well tubular metal structure 5. Thus, the downhole wireline tool 10 is submerged into the well or well tubular metal structure only by a wireline, e.g. with another kind of power supply line, such as an optical fibre, and not by tubing, such as coiled tubing, drill pipe or similar piping.

As shown in FIG. 2, the separation of the first section 6 from the second section 7 comprises machining part of the well tubular metal structure, thereby grinding a very small part of the well tubular metal structure into inconsiderable small pieces. Machining part of the well tubular metal structure is performed by cutting or milling a part of well tubular metal structure in the longitudinal extension.

In FIGS. 7-9, separation of the first section from the second section 7 comprises pulling the first section out of the borehole 4 after the machining. Then as shown in FIG. 7, the second well tubular metal structure 5B is mounted with an annular barrier 20 and then inserted into the borehole 4 so that the second well tubular metal structure is arranged at a distance from the second section of the first well tubular metal structure where the distance corresponds to the length of the annular barrier, so that the annular barrier abuts the second section 7.

The annular barrier comprises in FIGS. 7-9 a tubular metal part 52, an expandable metal sleeve 53 surrounding and connected to the tubular metal part providing an annular space 54 between the tubular metal part/well tubular metal structure and the expandable metal sleeve 53. The tubular metal part has an expansion opening 55 in order to expand the expandable metal sleeve 53.

In FIGS. 10-14, the annular barrier 20 comprises an expandable metal sleeve 53 but does not surround a tubular metal part as the annular barrier 20 is baseless having only the expandable metal sleeve. The annular barrier is inserted into the well by means of a tool after the second well tubular metal structure 5B is inserted into the borehole 4 so that the second well tubular metal structure is arranged at a distance from the second section of the first well tubular metal structure where the distance corresponds to the length of the annular barrier, so that the annular barrier abuts the second section 7. Then, the annular barrier is arranged opposite the distance, as shown in FIG. 11, the ends are expanded, and the intermediate part between the ends is expanded, as shown in FIG. 12.

The annular barrier 20 can be expanded in different ways. The annular barrier may be expanded by pressurising at least a part of the well tubular metal structure opposite the expansion opening and letting fluid into the annular space for expanding the expandable metal sleeve, e.g. by a tool string 47 or by plugging (e.g. dropping a ball into a ball seat) the well tubular metal structure below the annular barrier and pressurising the well tubular metal structure from surface, as shown in FIG. 9.

In another embodiment, expanding the annular barrier 20 is performed by expanding the tubular metal part and/or the expandable metal sleeve, e.g. by pulling a expandable cone or a mandrel through the tubular metal part, or if no tubular metal part is present by directly expanding the expandable metal sleeve to abut the inner face of the well tubular metal structure overlapping the first well tubular metal structure and the second well tubular metal structure, as shown in FIG. 11. Subsequently, the expandable metal sleeve is further expanded by pressuring the expandable metal sleeve from within e.g. by isolating an intermediate part 58 of the expandable metal sleeve, as shown in FIG. 12.

In FIG. 11, each of the ends 56, 57 of the expandable metal sleeve is radially expanded by an expandable bladder 61 so that one end 56 is overlapping the first well tubular metal structure and the other end is overlapping the second well tubular metal structure section. Subsequently, fluid is pumped out through tool openings 63 in the tool 47, expanding the expandable metal sleeve between the first well tubular metal structure and the second well tubular metal structure 5B to abut the wall of the borehole. Thus, the annular barrier 20 has a first barrier end 66 and a second barrier end 67, where the first barrier end is configured to overlap the first well tubular metal structure and the second barrier end 67 is configured to overlap the second well tubular metal structure. In order to enhance the sealing ability of the ends of the annular barrier, sealing elements may be arranged surrounding the outer face of the annular barrier ends as shown in FIGS. 10-13.

As shown in FIG. 14, the expandable metal sleeve 53 comprises sealing elements 64 and split ring-shaped elements 65 for back-up of the sealing element 64. An intermediate element 69 is provided between the sealing element 64 and the split ring-shaped elements 65. The sealing elements, the split ring-shaped elements 65 and the intermediate elements are arranged between two projections 71 forming a groove 72.

Even though not shown, the downhole method may further comprise providing a second zonal isolation at a second predetermined position in the annulus 2 between the wall 3 of the borehole and the well tubular metal structure. The first and second annular barrier provided at the first and second predetermined position may be expanded in one run or two runs. The downhole wireline tool may have means for holding a section of the well tubular metal structure in relation to a second section of the well tubular metal structure by having two anchoring sections 22.

The downhole wireline tool 10 providing the separation of the first section from the second section may be the same tool providing and expanding the annular barrier 20 so that the operation may be performed in one run instead of the two runs.

As shown in FIG. 15, the downhole wireline tool 10 comprises a tool housing 6*a* having a first housing part 7*a* and a second housing part 8*a* and a cutting arm 9 being pivotably connected with the first housing part about axis 41 so as to pivot within an angular range X relative to direction 37. The arm 9 has a cutting edge 10B in a first end. The arm 9 is movable between a retracted position and a projected position in relation to the tool housing. The arm is shown in its projected position in FIG. 15. The tool further comprises an arm activation assembly 11 for moving the cutting arm 9 between the retracted position and the projected position. A rotatable shaft 12 penetrates the second housing part 8*a* and is connected with, and forms part of, the first housing part for rotating the cutting arm.

The arm activation assembly 11 comprises a piston housing 13 arranged in the first housing part 7*a* and comprises a piston chamber 14. A piston member 15 is arranged inside the piston chamber and engages with the cutting arm 9, thereby moving the cutting arm 9 between the retracted position and the projected position. The piston member 15 is movable in a longitudinal direction of the downhole tubing cutter tool and has a first piston face 16 and a second piston face 17. Hydraulic fluid from the pump is pumped into a first chamber section 25 of the chamber 14 through a first fluid channel 18, applying a hydraulic pressure on the first piston face 16, moving the piston in a first direction, applying a projecting force on the cutting arm 9.

When the cutting arm is projected to press a cutting edge 10B against an inner face of the well tubular metal structure and when the cutting arm 9 is simultaneously rotated by the motor through the rotatable shaft, the cutting edge 10B is capable of cutting through the well tubular metal structure. Hereby, it is obtained that a first section of the well tubular metal structure can be separated from a second section of the well tubular metal. The arm activation assembly may be powered by the pump as shown or driven by the motor.

In FIG. 15, the rotatable shaft 12 supplies fluid to the first section 25 of the chamber 14. The fluid from the pump is supplied to the shaft 12 through a circumferential groove 27 fluidly connected with a second fluid channel 28 in the second housing part 8*a*. Thus, the fluid from the second fluid channel 28 is distributed in the circumferential groove 27, so that the first fluid channel 18 in the rotatable shaft 12 is always supplied with pressurised fluid from the pump while rotating. The circumferential groove 27 is sealed off by means of circumferential seals 29, such as O-rings, on both sides of the circumferential groove 27.

The piston member 15 moves in the longitudinal direction of the tool 10 inside the piston chamber and divides the chamber 14 into a first chamber section 25 and a second chamber section 26. When the piston member moves in the first direction, a spring member 40 abutting the second piston face 17 opposite the first piston face 16 is compressed. As the spring member is compressed, so is the second chamber section, and the fluid therein flows out through a fourth channel 44 fluidly connected with the first channel 18. The spring member, which is a helical spring surrounding part of the piston member, is arranged in the second chamber section 26 is thus compressed between the second piston face 17 and the piston chamber 14. The piston member has a first end 30 extending out of the piston housing 13 and engaging the cutting arm by having a circumferential groove 31 into which a second end 32 of the cutting arm extends. The second end of the cutting arm is rounded to be able to rotate in the groove. The cutting arm is pivotably connected with the first housing around a pivot point 33. In the other and second end 34 of the piston member, the piston member extends into the shaft 12. When the piston member is moved in the first direction, a space 45 is created between the second end 34 of the piston member and the shaft. This space 45 is in fluid communication with the well fluid through a third channel 35, which is illustrated by a dotted line. In this way, the piston does not have to overcome the pressure surrounding the tool in the well. The second end 34 of the piston member is provided with two circumferential seals 36 in order to seal off the piston chamber from the dirty well fluid.

When the cutting operation is complete and the well tubular metal structure has been separated into an upper and a lower part, the hydraulic pressure from the pump is no longer fed into the first channel, and the spring member forces the piston member 15 in a second direction opposite the first direction along the longitudinal direction 37 of the tool, as indicated in FIG. 15.

The downhole method may further comprise providing cement on top of the annular barrier to provide an abandonment plug. By providing a plug e.g. of cement within the well tubular metal structure, the well can then be abandoned.

The downhole wireline tool may further comprise a stroking tool providing the movement along the longitudinal extension of the well tubular metal structure 5. The stroking tool is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a driving unit such as a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole method for removal of at least part of a first well tubular metal structure in a borehole of an existing well having a top, the first well tubular metal structure having a longitudinal extension and a first end closest to the top, comprising:

inserting a downhole wireline tool having an anchor section and a machining device in the first well tubular metal structure, positioning the downhole wireline tool opposite a first section of the first well tubular metal structure so that the machining device is positioned 8-12 metres from the first end of the first well tubular metal structure and the anchor section is arranged above the machining device, anchoring the downhole wireline tool opposite the first section by activating the anchor section to abut an inner surface of the first well tubular metal structure and provide a radial force sufficient to fix the first section of 8-12 metres in relation to downhole wireline tool, separating the first section having a length of 8-12 metres from a second section of the first well tubular metal structure by machining into and along a circumference of the first well tubular metal structure, retrieving the first section from the well by pulling in the wireline together with the downhole wireline tool having the first section of 8-12 metres, creating a new first end of the first well tubular metal structure in the well, inserting the downhole wireline tool into the first well tubular metal structure again, positioning the downhole wireline tool opposite a new first section of the first well tubular metal structure so that the machining device is positioned 8-12 metres from the new first end of the first well tubular metal structure and the anchor section is arranged above the machining device, anchoring the downhole wireline tool opposite the new first section by activating the anchor section to abut the inner surface of the first well tubular metal structure and provide a radial force sufficient to fix the new first section of 8-12 metres in relation to downhole wireline tool, separating the new first section having a length of 8-12 metres from the rest of the first well tubular metal structure by machining into and along the circumference of the first well tubular metal structure, and retrieving the new first section from the well by pulling in the wireline together with the downhole wireline tool having the new first section of 8-12 metres.

2. A downhole method according to claim 1, wherein the first well tubular metal structure is separated into several first sections with a length of 8-12 metres.

3. A downhole method according to claim 1, further comprising machining into a liner hanger in order to release the part of the first well tubular metal structure hung off in the liner hanger.

4. A downhole method according to claim 1, wherein the first well tubular metal structure is separated into several first sections with a length of 8-12 metres until a predetermined position along the first well tubular metal structure.

5. A downhole method according to claim 4, further comprising setting a plug above or below the predetermined position.

6. A downhole method according to claim 4, further comprising inserting a cement tool into the well and ejecting cement into the borehole above the predetermined position.

7. A downhole method according to claim 4, further comprising inserting a second well tubular metal structure in the borehole above the predetermined position, wherein the second well tubular metal structure comprises at least one annular barrier.

8. A downhole method according to claim 7, wherein the annular barrier is arranged above the predetermined position and the second well tubular metal structure is arranged above the annular barrier.

9. A downhole method according to claim 8, wherein inserting the annular barrier is positioned by a downhole wireline tool string.

10. A downhole method according to claim 8, wherein the annular barrier comprises a tubular metal part, an expandable metal sleeve connected with and surrounding the tubular metal part providing an annular space between the tubular metal structure and the expandable metal sleeve, the tubular metal part having an expansion opening.

11. A downhole method according to claim 7, wherein the annular barrier comprises an expandable metal sleeve.

12. A downhole method according to claim 11, wherein expanding the annular barrier is performed by means of a mandrel and/or an expandable bladder.

13. A downhole method according to claim 7, wherein expanding the annular barrier is performed by pressurising at least a part of the second well tubular metal structure.

14. A downhole method according to claim 7, wherein the annular barrier has a first barrier end and a second barrier end, the first barrier end is configured to overlap the first well tubular metal structure and the second barrier end is configured to overlap the second well tubular metal structure.

15. A downhole system for performing the downhole method according to claim 1.

* * * * *